United States Patent [19]

Bolte et al.

[11] 4,287,287

[45] Sep. 1, 1981

[54] ELECTROSTATOGRAPHIC CARRIER COATED WITH THIXOTROPIC COMPOSITIONS

[75] Inventors: Steven B. Bolte, Webster; Richard B. Lewis, Williamson, both of N.Y.

[73] Assignee: Xerox Corporation, Stamford, Conn.

[21] Appl. No.: 116,066

[22] Filed: Jan. 28, 1980

[51] Int. Cl.[3] ..... G03G 9/00; G03G 9/10

[52] U.S. Cl. ..... 430/137; 427/216; 427/219; 430/108; 430/110; 148/6

[58] Field of Search ..... 430/108, 110, 137; 427/213, 221, 422

[56] References Cited

U.S. PATENT DOCUMENTS

| | | | |
|---|---|---|---|
| 3,725,118 | 4/1973 | Fuller | 430/137 X |
| 3,922,382 | 11/1975 | Kukla et al. | 430/137 |

OTHER PUBLICATIONS

Chem. Absts. 8th Coll. Index, pp. 31186–31187.
Chem. Absts. 9th Coll. Index, pp. 15671 GS–2GS.
Chem. Absts. vol. 83/61823f.

*Primary Examiner*—John D. Welsh
*Attorney, Agent, or Firm*—E. O. Palazzo

[57] ABSTRACT

Electrostatographic carrier coating compositions which provide porous carrier cores with coatings that are more uniform in thickness and complete in integrity are obtained by employing a thixotropic lacquer. The nature of the thixotropic lacquer is such that its viscosity is low under high shear rates, but high under low shear rates as found during the spreading and penetration of the lacquer on the carrier cores.

4 Claims, No Drawings

ELECTROSTATOGRAPHIC CARRIER COATED WITH THIXOTROPIC COMPOSITIONS

This invention is generally concerned with electrostatographic imaging systems and more specifically with improved carrier coating compositions which are useful in the development of electrophotographic images. It is well known to form and develop images on the surface of photoconductive materials by electrostatic methods such as described, for example, in U.S. Pat. Nos. 2,297,691; 2,277,013; 2,551,582; 3,220,324; and 3,220,833. In summary, these processes as described in the aforementioned patents involve the formation of an electrostatic latent charged image on an insulating electrophotographic element and rendering the latent image visible by a development step whereby the charged surface of the photoconductive element is brought into contact with a developer mixture. As described in U.S. Pat. No. 2,297,691, for example, the resulting electrostatic latent image is developed by depositing thereon a finely-divided electroscopic material referred to in the art as toner, the toner being generally attracted to the areas of the layer which retain a charge thus forming a toner image corresponding to the electrostatic latent image. Subsequently, the toner image can be transferred to a support surface such as paper and this transferred image can be permanently affixed to the support surface using a variety of techniques including pressure fixing, heat fixing, solvent fixing, and the like.

Many methods are known for applying the electroscopic particles to the latent image including cascade development, touchdown and magnetic brush as illustrated in U.S. Pat. Nos. 2,618,552; 2,895,847 and 3,245,823. One of the most widely used methods is cascade development wherein the developer material comprising relatively large carrier particles having finely-divided toner particles electrostatically clinging to the surface of the carrier particles is conveyed to and rolled or cascaded across the electrostatic latent image-bearing surface. Magnetic brush development is also known and involves the use of a developer material comprising toner and magnetic carrier particles which are carried by a magnet so that the magnetic field produced by the magnet causes alignment of the magnetic carriers in a brush-like configuration. Subsequently, this brush is brought into contact with the electrostatic latent image-bearing surface causing the toner particles to be attracted from the brush to the electrostatic latent image by electrostatic attraction, as more specifically disclosed in U.S. Pat. No. 2,874,063.

Carrier materials used in the development of electrostatic latent images are described in many patents including, for example, U.S. Pat. No. 3,590,000. The type of carrier material to be used depends on many factors such as the type of development used, the quality of the development desired, the type of photoconductive material employed and the like. Generally, however, the materials used as carrier surfaces or carrier particles or the coating thereon should have a triboelectric value commensurate with the triboelectric value of the toner in order to generate electrostatic adhesion of the toner to the carrier. Carriers should be selected that are not brittle so as to cause flaking of the surface or particle break-up under the forces exerted on the carrier during recycle as such causes undesirable effects and could, for example, be transferred to the copy surface thereby reducing the quality of the final image.

There have been recent efforts to develop carriers and particularly coatings for carrier particles in order to obtain better development quality and also to obtain a material that can be recycled and does not cause any adverse effects to the photoconductor. Some of the coatings commercially utilized deteriorate rapidly especially when employed in a continuous process whereby the entire coating may separate from the carrier core in the form of chips or flakes as a result of poorly adhering coating material and fail upon impact and abrasive contact with machine parts and other carrier particles. Such carrier particles generally cannot be reclaimed and reused and usually provide poor print quality results. Further, the triboelectric values of some carrier coatings have been found to fluctuate when changes in relative humidity occur and thus these carriers are not desirable for use in electrostatographic systems as they can adversely affect the quality of the developed image.

It is common knowledge among those experienced in electrostatographic developer materials that carrier coatings are generally not uniform in thickness nor complete in coating the entire carrier core. This is especially true of microporous core surfaces of carrier materials such as ferrites, magnetite and sponge iron. Due to the porous nature of such core materials, carrier coating solutions will penetrate excessively into the core material resulting in non-uniform and incomplete coating of the core material. This is so because most of the coating material is found to reside in the pores of carrier cores and not at the surface thereof and therefore is not available for triboelectric charging when the coated carrier particles are mixed with finely-divided toner particles. Attempts to resolve this problem by increasing carrier coating weights, for example, to as much as up to about 3 percent or greater to provide an effective triboelectric charging coating to the carrier particles necessarily involves handling excessive quantities of solvents and usually results in low product yields. Further, poorly-coated porous carrier particles when combined and mixed with finely-divided toner particles provide triboelectric charging levels which are too low for practical use. In addition, poorly-coated metallic carrier particles have a high incidence of electrical breakdown at low applied voltages leading to shorting between the carrier particles and the photoreceptor. Thus, there is a continuing need for an improved carrier material and developer mixture.

It is therefore an object of this invention to provide developer materials which overcome the above-noted deficiencies.

It is another object of this invention to provide carrier materials having coatings thereon which are more uniform in thickness and complete in coating integrity.

It is a further object of this invention to provide carrier coating compositions which reduce the penetration of coating lacquers into the pores of carrier cores.

It is another object of this invention to provide developers having physical and chemical properties superior to those of known developer materials.

The above and other objects are accomplished by providing coated carrier particles for electrostatographic developer mixtures comprising finely-divided toner particles electrostatically clinging to the surface of the carrier particles. More specifically, the carrier particles of this invention are provided by coating carrier core particles having an average diameter of from between about 30 microns and about 1,000 microns with from between about 0.05 percent and about 3.0 percent by weight, based on the weight of the coated carrier particles, of a thixotropic lacquer. The nature of the thixotropic lacquer is such that its viscosity is low under high shear rates as in a nozzle sprayer, but high under low shear rates as found during the spreading and penetration of the lacquer on carrier cores thus producing more uniform, thicker coatings at low coating weights without significant penetration into the pores of the carrier cores. When the thixotropic lacquer has been applied to the carrier cores, the lacquer droplets initially spread out over the surface thereof, but the shear rate continually decreases causing the lacquer viscosity to increase and slow down the spreading and penetration of the lacquer.

The carrier coating compositions of this invention comprise a thixotropic lacquer prepared by heat melting or dissolving a resinous coating material in a suitable solvent. To the fluid resinous coating material is added a suitable agent to provide the lacquer with thixotropic properties as previously described. Typical agents that provide thixotropic properties to resinous lacquers include fumed silica, fumed alumina, and fumed titanium dioxide.

After preparation of the thixotropic lacquer, it is then applied to electrostatographic carrier cores by conventional coating methods, for example, by fluidized bed coating, shaking and tumbling with removal of any solvent present by evaporation and the lacquer is dried to prevent agglomeration of the coated carrier cores.

Any suitable coating thickness may be employed. However, a coating having a thickness of at least sufficient to form a continuous film is preferred because the carrier coating will then possess sufficient thickness to resist abrasion and prevent pinholes which adversely affect the triboelectric properties of the coated carrier particles. As earlier indicated, a coating weight of up to about 3 percent by weight, based on the weight of the coated carrier particles, of the thixotropic lacquer generally provides satisfactory results.

Any suitable solid material may be employed as the carrier core in this invention. However, ist is preferred that the carrier core material comprise low density, porous, magnetic or magnetically-attractable metal particles having a gritty, oxidized surface and a high surface area, i.e., a surface area which is at least about 200 $cm^2$/gram and up to about 1300 $cm^2$/gram of carrier material. Typical satisfactory carrier core materials include iron, steel, ferrite, magnetite, nickel and mixtures thereof. For ultimate use in an electrostatographic magnetic brush development system, it is preferred that the carrier core materials have an average particle size of between about 30 microns and about 200 microns. Excellent results have been obtained when the carrier core materials comprise porous, sponge iron or steel grit. The carrier core materials are generally produced by gas or water atomization processes or by reduction of suitable sized ore to yield sponge powder particles. The powders produced have a gritty surface, are porous, and have high surface areas. By comparison, conventional carrier core materials usually have a high density and smooth surface characteristics.

The resinous insulating coating material employed in this invention may be any suitable insulating coating material. Typical insulating coating materials include vinyl chloride-vinyl acetate copolymers, styrene-acrylate-organosilicon terpolymers, natural resins such as caoutchouc, carnauba, colophony, copal, dammar, jalap, storax; thermoplastic resins including the polyolefins such as polyethylene, polypropylene, chlorinated polyethylene, chlorosulfonated polyethylene, and copolymers and mixtures thereof; polyvinyls and polyvinylidenes such as polystyrene, polymethyl-styrene, polymethyl methacrylate, polyacrylonitrile, polyvinyl acetate, polyvinyl alcohol, polyvinyl butyral, polyvinyl chloride, polyvinyl pyridine, polyvinyl carbazole, polyvinyl ethers, and polyvinyl ketones; fluorocarbons such as polytetrafluoroethylene, polyvinyl fluoride, polyvinylidene fluoride; and polychlorotrifluoroethylene; polyamides such as polycaprolactam and polyhexamethylene adipamide; polyesters such as polyethylene terephthalate; polyurethanes; polysulfides, polycarbonates, thermosetting resins including phenolic resins such as phenolformaldehyde, phenol-furfural and resorcinol formaldehyde; amino resins such as urea-formaldehyde and melamine-formaldehyde; polyester resins; epoxy resins; and the like. Many of the foregoing and other typical carrier coating materials are described by L. E. Walkup in U.S. Pat. No. 2,618,551; B. B. Jacknow et al in U.S. Pat. No. 3,526,533; and R. J. Hagenbach et al in U.S. Pat. Nos. 3,533,835 and 3,658,500.

The resinous insulating coating material employed in this invention may be dissolved in any suitable true organic solvent, i.e., a liquid unreactive to the system but capable of dissolving the coating material. Typical solvents include the chlorinated, ketone, ester and hydrocarbon solvents such as, for example, xylene, benzene, toluene, hexane, cyclopentane, 1,1,1-trichloroethylene, ethyl acetate, methyl ethyl ketone, and the like. However, it is preferred that the solvents be nonpolar since polar solvents containing metallic oxides can form chains and networks within the lacquer thus increasing the thixotropy of the coating solution.

Any suitable finely-divided toner material may be employed with the coated carrier materials of this invention. Typical toner materials include, for example, gum copal, gum sandarac, rosin, asphaltum, phenol-formaldehyde resins, rosin-modified phenol-formaldehyde resins, methacrylate resins, polystyrene resins, polystyrene-butadiene resins, polyester resins, polyethylene resins, epoxy resins and copolymers and mixtures thereof. The particular type of toner material to be used depends to some extent upon the separation of the toner particles from the coated carrier particles in the triboelectric series. Patents describing typical electroscopic toner compositions include U.S. Pat. Nos. 2,659,670; 3,079,342; Re. 25,136 and 2,788,288. Generally, the toner materials have an average particle diameter of between about 5 and 15 microns. Preferred toner resins include those containing a high content of styrene because they generate high triboelectric charging values, and a greater degree of image definition is achieved when employed with the carrier materials of this invention. Generally speaking, satisfactory results are obtained when about 1 part by weight toner is used with about 10 to 200 parts by weight of carrier material.

Any suitable pigment or dye may be employed as the colorant for the toner particles. Toner colorants are well known and include, for example, carbon black, nigrosine dye, aniline blue, Calco Oil Blue, chrome yellow, ultramarine blue, duPont Oil Red, Quinoline Yellow, methylene blue chloride, phthalocyanine blue, Malachite Green Oxalate, lamp black, iron oxide, Rose Bengal and mixtures thereof. The pigment and/or dye should be present in the toner in a quantity sufficient to render it highly colored so that it will form a clearly visible image on a recording member. Thus, for example, where conventional xerographic copies of typed documents are desired, the toner may comprise a black pigment such as carbon black or a black dye such as Amaplast Black dye, available from National Aniline Products, Inc. Preferably, the pigment is employed in an amount from about 3 percent to about 20 percent by weight, based on the total weight of the colored toner. If the toner colorant employed is a dye, substantially smaller quantities of colorant may be used.

The developer compositions of the instant invention may be employed to develop electrostatic latent images on any suitable electrostatic latent image-bearing surface including conventional photoconductive surfaces. Well-known photoconductive materials include vitreous selenium, organic or inorganic photoconductors embedded in a non-photoconductive matrix, organic or inorganic photoconductors embedded in a photoconductive matrix, or the like. Representative patents in which photoconductive materials are disclosed include U.S. Pat. No. 2,803,542 to Ullrich; U.S. Pat. No. 2,970,906 to Bixby; U.S. Pat. No. 3,121,006 to Middleton; U.S. Pat. No. 3,121,007 to Middleton; and U.S. Pat. No. 3,151,982 to Corrsin.

The following examples further define, describe and compare methods of preparing the carrier materials of the present invention and of utilizing them to develop electrostatic latent images. Parts and percentages are by weight unless otherwise indicated.

EXAMPLE I

A control carrier material was prepared employing about 99.7 parts of coarse-surfaced nickel-zinc ferrite carrier cores having an average particle diameter of about 100 microns. A coating composition comprising about 5 percent solids of styrene and a methacrylate ester as disclosed in U.S. Pat. No. 3,526,533 dissolved in toluene was spray-dried onto the fluidized carrier cores as to provide them with a coating weight of about 0.3 percent.

About 98 parts by weight of the coated carrier particles was mixed with 2 parts by weight of toner particles having an average diameter of about 12 microns. The composition of the toner particles comprised about 90 parts of a 65/35 styrene/n-butyl methacrylate copolymer and about 10 parts of carbon black. The mixture of carrier particles and toner particles was tumbled in a glass jar on a roll mill for almost one hour. It was found that the triboelectric charge generated on the toner material was about −7 microcoulombs per gram of toner.

EXAMPLE II

A carrier material was prepared employing about 99.7 parts of coarse-surfaced nickel-zinc ferrite carrier cores having an average particle diameter of about 100 microns as in Example I. A coating composition comprising about 5 percent solids of styrene and a methacrylate ester as disclosed in U.S. Pat. No. 3,526,533 dissolved in toluene was prepared. About 5 percent by weight, based on the weight of the coating composition, of fumed silica particles commercially available as Aerosil R972 from DeGussa, Inc., New York, New York, was added to the coating composition and thoroughly mixed therewith by ultrasonic means. The resulting coating mixture was spray-dried onto the fluidized carrier cores as to provide them with a coating weight of about 0.3 percent.

About 98 parts by weight of the coated carrier particles was mixed with about 2 parts by weight of toner particles having an average diameter of about 12 microns. The composition of the toner particles comprised about 90 parts of a 65/35 styrene-n-butyl methacrylate copolymer and about 10 parts of carbon black. The mixture of carrier particles and toner particles was tumbled in a glass jar on a roll mill for about one hour as in Example I. It was found that this developer mixture generated a higher triboelectric response than that of Example I in that the triboelectric charge generated on the toner material was about −11 microcoulombs per gram of toner. The increased triboelectric charge obtained with this developer mixture is believed to be due to the higher amount of thixotropic coating material present on the carrier surface instead of it sorbing into the pores of the nickel-zinc ferrite carrier cores as in Example I.

The developer mixture was employed in a magnetic brush development fixture to develop an electrostatic latent image and was found to provide excellent prints of greater than 1.3 optical density units with good image background.

EXAMPLE III

A carrier material was prepared employing about 99.3 parts of coarse-surfaced nickel-zinc ferrite carrier cores having an average particle diameter of about 100 microns. A coating composition comprising about 5 percent solids of styrene and a methacrylate ester as disclosed in U.S. Pat. No. 3,526,533 dissolved in toluene was spray-dried onto the fluidized carrier cores as to provide them with a coating weight of about 0.7 percent. This carrier material was labeled Carrier "A".

A second carrier material was prepared employing about 99.3 parts of coarse-surfaced nickel-zinc ferrite carrier cores having an average particle diameter of about 100 microns. A coating composition comprising about 5 percent solids of styrene and a methacrylate ester as disclosed in U.S. Pat. No. 3,526,533 dissolved in toluene was prepared. About 5 percent by weight, based on the weight of the coating composition, of fumed silica particles commercially available as Aerosil R972 from DeGussa, Inc., New York, New York, was added to the coating composition and thoroughly mixed therewith by ultrasonic means. The resulting coating mixture was spray-dried onto the fluidized carrier cores as to provide them with a coating weight of about 0.7 percent. This carrier material was labeled Carrier "B".

When comparing the triboelectric charging properties of developer mixtures prepared from Carrier "A" and Carrier "B" with the toner composition of Example I, it was found that the triboelectric charge is increased by the use of the thixotropic coating composition of Carrier "B". Of equal importance, the integrity of the coating of Carrier "B" is greatly improved over that of Carrier "A". In addition, the coating on the surface of Carrier "B" is thicker and more uniform than that of Carrier "A" upon examination of cross-sections of the respective carrier materials with a scanning electron microscope.

EXAMPLE IV

A carrier material was prepared employing about 97.5 parts of sponge iron carrier cores having an average particle diameter of about 150 microns. The sponge iron cores are commercially available under the tradename Ancor EN 80/150 from Hoeganaes Corporation, Riverton, New Jersey. A primer coating comprising about 5 percent solids of polystyrene in toluene was spray-dried onto the bare sponge iron cores to provide them with a coating weight of about 2.5 percent. This carrier material was labeled Carrier "C".

A second carrier material was prepared employing about 97.5 parts of the above-identified sponge iron carrier cores. A primary coating composition comprising about 5 percent solids of polystyrene in toluene was prepared. About 5 percent by weight, based on the weight of the polystyrene, of fumed silica particles as in Example III was added to the coating composition and thoroughly mixed therewith by ultrasonic means. The resulting coating mixture was spray-dried onto the bare sponge iron cores to provide them with a coating weight of about 2.5 percent. This carrier material was labeled Carrier "D".

When comparing the coating characteristics of Carrier "C" and Carrier "D", it was found that the thixotropic lacquer employed to coat Carrier "D" prevented penetration into the highly porous sponge iron cores and forms a more uniform coating than that of Carrier "C".

Carrier "C" and Carrier "D" were subsequently coated with 1.2 parts by weight of a fluoropolymer composition commercially available under the tradename KEL F-800 from the 3M Corporation per 98.8 parts of carrier material.

About 98 parts by weight of the coated carrier particles was mixed with about 2 parts by weight of toner particles having an average diameter of about 12 microns. The composition of the toner particles comprised about 90 parts of a 65/35 styrene-n-butyl methacrylate copolymer and about 10 parts of carbon black. The mixture of carrier particles and toner particles was tumbled in a glass jar on a roll mill for about one hour as in Example I. It was found that the developer mixture of Carrier "D" generated a triboelectric charge of about +14 microcoulombs per gram of toner.

Very good xerographic prints were obtained with this developer mixture via magnetic brush development.

Although specific materials and conditions are set forth in the foregoing examples, these are merely intended as illustrations of the present invention. Various other suitable components, additives, colorants, and development processes such as those listed above may be substituted for those in the examples with similar results. Other materials may also be added to the toner or carrier to sensitize, synergize or otherwise improve the fusing properties or other desirable properties of the system.

Other modifications of the present invention will occur to those skilled in the art upon a reading of the present disclosure. These are intended to be included within the scope of this invention.

What is claimed is:

1. An improved process for preparing coated electrostatographic carrier particles, for use in developing compositions employed in the development of electrostatic latent images in an electrophotographic imaging device, comprising coating carrier core particles selected from the group consisting of iron, steel, ferrite, magnetite, nickel, and mixtures thereof, which particles have an average diameter of between about 30 microns and about 1,000 microns, by spray drying onto said particles a thixotropic coating lacquer comprised of fumed silica particles, in an amount of from about 0.05 percent to about 3.0 percent by weight based on the weight of the coated carrier particles, whereby the properties of the fumed silica particles cause a reduction in the penetration of such particles into the pores of the carrier core particles, thereby producing particles of a stable triboelectric charge.

2. A process in accordance claim 1 wherein the fumed silica particles are obtained by dissolving a resinous coating material, and adding thereto silica particles.

3. A process in accordance with claim 1 wherein the fumed silica particles contain an organic non-polar solvent.

4. A process in accordance with claim 1 wherein the carrier core is comprised of magnetite, and the silica coating is present in the form of a continuous film.

* * * * *